US010862186B2

(12) United States Patent
de Rijk et al.

(10) Patent No.: US 10,862,186 B2
(45) Date of Patent: Dec. 8, 2020

(54) WAVEGUIDE DEVICE COMPRISING A CORE HAVING A WAVEGUIDE CHANNEL, WHERE A SMOOTHING LAYER AND A CONDUCTIVE LAYER OF AT LEAST 5 SKIN DEPTH ARE FORMED ON AN INNER SURFACE OF THE WAVEGUIDE CHANNEL

(71) Applicant: SWISSto12 SA, Ecublens (CH)

(72) Inventors: Emile de Rijk, Lausanne (CH); Mirko Favre, Cully (CH); Mathieu Billod, Presilly (FR); Alexandre Dimitriades, Nyon (CH)

(73) Assignee: SWISSTO12 SA, Renens (CH)

( * ) Notice: Subject to any disclaimer, the term of this patent is extended or adjusted under 35 U.S.C. 154(b) by 90 days.

(21) Appl. No.: 16/304,760

(22) PCT Filed: May 30, 2017

(86) PCT No.: PCT/IB2017/053178
§ 371 (c)(1),
(2) Date: Nov. 27, 2018

(87) PCT Pub. No.: WO2017/208153
PCT Pub. Date: Dec. 7, 2017

(65) Prior Publication Data

US 2020/0127358 A1 Apr. 23, 2020

(30) Foreign Application Priority Data

May 30, 2016 (FR) ..... 16 00865

(51) Int. Cl.
*H01P 3/12* (2006.01)
*H01P 11/00* (2006.01)

(52) U.S. Cl.
CPC ..... *H01P 3/12* (2013.01); *H01P 11/002* (2013.01)

(58) Field of Classification Search
CPC ..... H01P 3/12; H01P 3/14; H01P 3/18; H01P 11/002
USPC ..... 333/239
See application file for complete search history.

(56) References Cited

U.S. PATENT DOCUMENTS 3,195,079 A 7/1965 Burton et al.
3,769,618 A 10/1973 Freedman et al.
3,982,215 A * 9/1976 Lo et al. ..... H01P 1/208 333/208

(Continued)

FOREIGN PATENT DOCUMENTS

CN 102623647 A 8/2012
WO 2016030490 A1 3/2016

OTHER PUBLICATIONS

International Search Report for PCT/IB2017/053178 dated Aug. 30, 2017.

(Continued)

*Primary Examiner* — Benny T Lee
(74) *Attorney, Agent, or Firm* — Pearne & Gordon LLP

(57) ABSTRACT

A waveguide device for guiding a radio frequency signal at a determined frequency f, the device including a body having side walls with outer surfaces and inner surfaces, the inner surfaces defining a waveguide channel. A conductive layer covers the inner surface of the body, the conductive layer being formed of a metal having a skin depth δ at frequency f. The conductive layer has a thickness at least twenty times as large as the skin depth δ.

18 Claims, 9 Drawing Sheets

(56) References Cited

U.S. PATENT DOCUMENTS

| | | | | |
|---|---|---|---|---|
| 2010/0321136 | A1* | 12/2010 | Ligander et al. ..... | H01P 3/121<br>333/254 |
| 2012/0033931 | A1 | 2/2012 | Hideyuki et al. | |

OTHER PUBLICATIONS

Written Opinion for PCT/IB2017/053178 dated Aug. 30, 2017.
D'Auria, Mario, et al., "3-D Printed Metal-Pipe Rectangular Waveguides", IEEE Transactions on Components, Packaging and Manufacturing Technology, vol. 5, No. 9, Aug. 21, 2015.

* cited by examiner

-- PRIOR ART --

-- PRIOR ART --

-- PRIOR ART --

-- PRIOR ART --

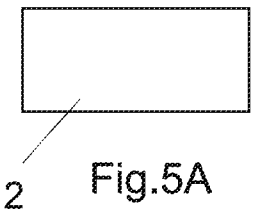
Fig.5A
-- PRIOR ART --
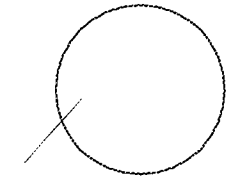
Fig.5B
-- PRIOR ART --
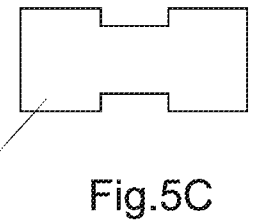
Fig.5C
-- PRIOR ART --
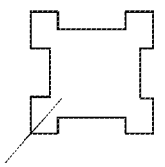
Fig.5D
-- PRIOR ART --
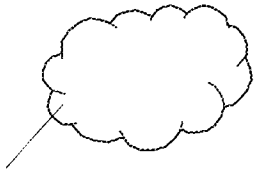
Fig.5E
-- PRIOR ART --
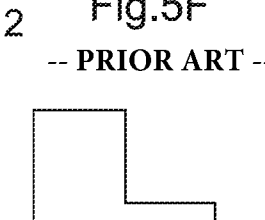
Fig.5F
-- PRIOR ART --
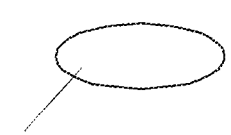
Fig.5G
-- PRIOR ART --
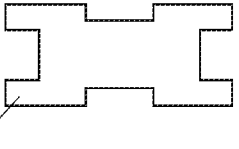
Fig.5H
-- PRIOR ART --
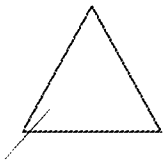
Fig.5I
-- PRIOR ART --
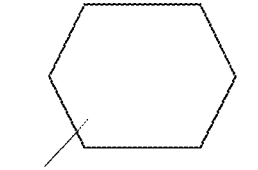
Fig.5J
-- PRIOR ART --
Fig.5K
-- PRIOR ART --
Fig.5L
-- PRIOR ART --
Fig.5M
-- PRIOR ART --
Fig.5N
-- PRIOR ART --
Fig.5O
-- PRIOR ART --

-- PRIOR ART --

-- PRIOR ART --

-- PRIOR ART --

| Material | Young Modulus [N/mm2] |
|---|---|
| Nickel layer | 214000 |
| Polymer | 10500 |
| Aluminium | 72500 |

WAVEGUIDE DEVICE COMPRISING A CORE HAVING A WAVEGUIDE CHANNEL, WHERE A SMOOTHING LAYER AND A CONDUCTIVE LAYER OF AT LEAST 5 SKIN DEPTH ARE FORMED ON AN INNER SURFACE OF THE WAVEGUIDE CHANNEL

FIELD OF THE INVENTION

The present invention relates to a waveguide device, to a method for manufacturing said waveguide and to a computer medium for manufacturing said waveguide.

DESCRIPTION OF RELATED ART

Radiofrequency (RF) signals can propagate either in a free space or in waveguide devices. These waveguide devices are used to channel the RF signals or to manipulate them.

The present invention particularly relates to passive RF devices that allow radiofrequency signals to be propagated and manipulated without using active electronic components. Passive waveguides can be divided into three distinct categories:

devices based on guiding waves inside hollow metal channels, commonly called "waveguides";

devices based on guiding waves inside dielectric substrates;

devices based on guiding waves by means of surface waves on metal substrates, such as PCB printed circuits, microstrips, etc.

The present invention particularly relates to the first aforementioned category, collectively denoted hereafter as "waveguides". Examples of such devices include waveguides as such, filters, antennae, mode converters, etc. These devices can be used for signal routing, frequency filtering, separating or recombining signals, transmitting or receiving signals in or from free space, etc.

An example of a conventional waveguide 1 is shown in FIG. 1. It is formed by a hollow device, the shape and the proportions of which determine the propagation characteristics for a given wavelength of the electromagnetic signal. The conventional waveguides that are used for radiofrequency signals have internal openings with rectangular or circular sections. They allow propagation of electromagnetic modes (along a z-axis shown in FIG. 2) corresponding to various electromagnetic field distributions along their section. In the example shown, the waveguides 1 exhibit a height B along a y axis (e.g., shown in FIG. 2) and a width A along an x axis (e.g., shown in FIG. 2).

FIG. 2 schematically shows the electric E and magnetic H field lines in such a waveguide 1. The dominant propagation mode in this case is the electric transverse mode called TE10.

FIGS. 3 and 4 show a waveguide 1 with a circular section, wherein an opening 2 is formed in the waveguide 1. Circular transmission modes can propagate in such a waveguide. The arrows in FIG. 4 show the transmission mode TE11, the substantially vertical arrows show the electric field, the more horizontal arrows show the magnetic field. The orientation of the field changes through the section of the waveguide.

Apart from these examples of rectangular or circular waveguide openings 2, other opening shapes have been contemplated or can be contemplated within the scope of the invention and which allow an electromagnetic mode to be maintained at a given signal frequency in order to transmit an electromagnetic signal. Examples of possible waveguide openings 2 are shown in FIGS. 5A-5O. The surface that is shown corresponds to the section of the waveguide opening 2, defined by electrically conductive surfaces. The shape and the surface of the section also can vary in the main direction of the waveguide device.

Manufacturing waveguides with complex sections is difficult and expensive. Recent works nevertheless have demonstrated the possibility of producing waveguide components, including antennae, waveguides, filters, converters, etc., using additive manufacturing methods, for example, by 3D printing. In particular, additive manufacturing is known for waveguides comprising both non-conductive materials, such as polymers or ceramics, and metal conductors.

Waveguides comprising ceramic or polymer walls manufactured using an additive method, then covered with a metal plating have been suggested in particular. The inner surfaces of the waveguide in effect must be electrically conductive in order to operate. The use of a non-conductive core allows, on the one hand, the weight and the cost of the device to be reduced and, on the other hand, allows 3D printing methods to be implemented that are adapted to polymers or to ceramics and allow high precision parts to be produced with a low roughness level.

By way of an example, the article by Mario D'Auria et al, "3-D PRINTED METAL-PIPE RECTANGULAR WAVEGUIDES", 21 Aug. 2015, IEEE Transactions on components, packaging and manufacturing technologies, Vol. 5, No. 9, pages 1339-1349, describes, in paragraph III, a method for manufacturing the core of a waveguide by Fused Deposition Modeling (FDM). This document acknowledges that the resolution obtained by this method is limited by the diameter of the extrusion nozzle, which is 400 micrometers. It thus produces a relatively rough core. A 3 micrometer priming layer is deposited onto this core, the thickness of this layer, relative to the resolution of the method for printing the core and relative to the roughness Ra of the core, is insufficient for producing a significant level of smoothing. A 27 micrometer copper conductive layer is subsequently deposited onto this priming layer.

An example of a waveguide 1 produced by additive manufacturing is shown in FIGS. 6A and 6B. It comprises a non-conductive core 3, for example, made of polymer or ceramic, which is manufactured, for example, by stereolithography, by selective laser melting or by another additive method, and which defines an inner opening 2 for the propagation of the RF signal. In this example, the opening has a rectangular section of width a and of height b (shown in FIG. 6A). The inner walls of this core around the opening 2 are coated with an electrically conductive coating 4, for example, a metal plating. In this example, outer walls 8 of the waveguide 1 are also coated with a metal plating 5 (shown in FIG. 6A), which can be the same metal and the same thickness. This outer coating strengthens the waveguide against external mechanical or chemical stresses.

FIG. 7 shows a variation of a waveguide 1 similar to that of FIGS. 6A and 6B (wherein similar elements are denoted by similarly corresponding reference numerals), but without the conductive coating on the outer faces.

The waveguides are typically used outside, for example, in the aerospace field (airplane, helicopter, drone) to equip a spacecraft, on a seafaring vessel or on an underwater craft, on craft circulating in the desert or in high mountains, in each case in hostile and even extreme conditions. In these environments, the waveguides are particularly exposed to:

extreme pressures and temperatures that significantly vary, which induces repeated thermal shocks;

a mechanical stress, the waveguide being integrated in a craft that experiences shocks, vibrations and loads that affect the waveguide;

hostile meteorological and environmental conditions, in which the craft equipped with waveguides circulate (wind, ice, moisture, sand, salt, fungi/bacteria).

In order to address these constraints, waveguides are known that are formed by assembling previously machined metal plates, which allow waveguides to be manufactured that are capable of circulating in hostile environments. However, manufacturing these waveguides is often difficult, expensive and hard to adapt to the manufacture of waveguides that are light and have complex shapes.

With respect to waveguides that are assembled by additive manufacturing, existing techniques do not allow waveguides to be manufactured that are strong enough to be able to circulate in hostile environments. Existing waveguides, which are manufactured by additive manufacturing of a polymer core, the inner surface of which is covered with metal, do not exhibit mechanical and structural properties that allow satisfactory use in the hostile environments where the waveguides are generally used. When exposed to significant pressure or temperature variations, the structure of these waveguides is unstable and tends to degrade, which disrupts the transmission of the RF signal. Furthermore, existing waveguides, manufactured by additive manufacturing of a conductive material, such as a metal material, have surface finishes with excessively low quality, particularly with excessively high roughness, which degrades the RF performance levels of the waveguide and makes additive manufacturing difficult to use for this application.

BRIEF SUMMARY OF THE INVENTION

An aim of the present invention is to propose a waveguide device that is without or that minimizes the limitations of the known devices.

Another aim of the invention is to provide a waveguide device by additive manufacturing that can be used in hostile conditions.

According to the invention, these aims are particularly achieved by means of a waveguide device for guiding a radiofrequency signal at a determined frequency f, the device comprising:

a core manufactured by additive manufacturing made of conductive or, preferably, non-conductive material, comprising side walls with outer surfaces and inner surfaces, the inner surfaces defining a waveguide channel;

a smoothing layer covering the inner surface of the core, produced so as to at least partially smooth the irregularities in the layer of the inner surface of the core;

a metal conductive layer covering the smoothing layer, said conductive layer being formed of a metal characterized by a skin depth δ at the frequency f, the conductive layer having a thickness that is at least five times as large as said skin depth δ, preferably at least twenty times as large as said skin depth.

The skin depth δ is defined as:

$$\delta = \sqrt{\frac{2}{\mu 2\pi f \sigma}}$$

where μ is the magnetic permeability of the plated metal, f is the radiofrequency of the signal to be transmitted and σ is the electric conductivity of the plated metal. Intuitively, it involves the thickness of the zone where the current is concentrated in the conductor at a given frequency.

The solution described above particularly has the advantage, compared to the prior art, of providing waveguides assembled by additive manufacturing that are more resistant to the constraints to which they are exposed (thermal, mechanical, meteorological and environmental constraints).

In the waveguides that are assembled by additive manufacturing according to existing methods, the structural, mechanical, thermal and chemical properties basically depend on the properties of the core. Typically, waveguides are known in which the conductive layer that is deposited onto the core is very thin, thinner than the skin depth of the metal forming the conductive layer. Thus, it has generally been acknowledged that in order to improve the structural and mechanical properties of waveguides the thickness and/or the stiffness of the core needed to be increased. It was also acknowledged that the thickness of the conductive layer needed to be reduced in order to lighten the structure.

The inventors have discovered that by increasing the thickness of the conductive layer, such that the conductive layer reaches a thickness that is at least five times as large as the skin depth δ of the metal of the conductive layer, preferably at least twenty times as large as this depth, the structural, mechanical, thermal and chemical properties of the waveguide predominantly depend, and even practically exclusively depend, on the conductive layer. This surprising behavior is observed even though the thickness of the conductive layer remains much lower than the thickness of the core.

In one embodiment, the resistance of the device, selected from tensile, torsion or bending resistance, or from a combination of said resistances, is predominantly imparted by the conductive layer. For example, one way of characterizing the resistance of a device is to measure the Young's modulus. It is acknowledged that, with respect to a material, the higher the Young's modulus, the stiffer the material. For example, steel has a higher Young's modulus than rubber. According to one embodiment, the conductive layer is formed of metal and is thinner than the core and yet it is the metal layer that provides the key stiffness for the device. Thus, it is possible to reduce the thickness of the core, and thus the dimensions thereof, while improving the tensile, torsion and bending resistance of the device (see FIG. 12). Being able to reduce the thickness of the walls, and thus the dimensions of the waveguides, while increasing the tensile (for example, the stiffness), torsion and bending resistance of the waveguides is advantageous, particularly for spacecraft or underwater craft or when the space available for each component is limited.

In one embodiment, the resistance of the device, selected from tensile, torsion or bending resistance, or from a combination of said resistances, is predominantly imparted by the conductive layer over the range of operational temperatures of the device. Operational temperatures are understood to be temperatures between −150° C. and +150° C. This range of temperatures covers most temperatures prevailing where the device according to the invention is likely to circulate (space, desert, deep waters, etc.).

In one embodiment, the thickness of the conductive layer is between twenty times and sixty times as large as the skin depth S. This embodiment allows the roughness of the conductive surface to be reduced or even removed. This also allows the tensile, torsion and bending resistance of the device, for example, the stiffness of the waveguide, to be enhanced.

In one embodiment, the thickness of the conductive layer is between sixty times and a thousand times as large as the skin depth S. Such a conductive layer thickness particularly allows the tensile, torsion and bending resistance of the device, for example, the stiffness of the waveguide, to be enhanced.

The device comprises a smoothing layer between the core and the conductive layer. Upon completion of additive manufacturing of the core, it has been observed that the additive manufacturing process creates significant roughness (for example, hollows and bumps), particularly on the edges and on the surface of the core, particularly on the angled edges. These hollows and bumps can assume the form of the steps of a staircase, with each step representing the addition of a layer of non-conductive material during additive manufacturing. It has been observed that after the core is covered with a thin conductive layer, the roughness of the core remained, such that after metallization the surface still exhibited roughness that disrupted the transmission of the RF signal. In this case, adding a smoothing layer between the core and the conductive layer allows this roughness to be reduced or even removed, which improves the transmission of the RF signal. The smoothing layer can be made of conductive or non-conductive material.

The thickness of this smoothing layer preferably is between 5 and 500 microns, preferably between 10 and 150 microns, preferably between 20 and 150 microns. In the case of manufacturing the core by stereolithography or by selective laser melting, this thickness allows the surface irregularities due to the printing method to be effectively smoothed.

The thickness of said smoothing layer preferably is greater than or equal to the roughness (Ra) of the core.

The thickness of said smoothing layer preferably is greater than or equal to the resolution of the method for manufacturing the core.

When the smoothing layer comprises a weakly conducting material, for example, nickel, transmission of the RF signal is basically provided by the outer metal conductive layer, the influence of the smoothing layer is negligible, and in this case the thickness of the outer conductive layer must be at least five times as large as the skin depth δ, preferably at least 20 times as large as the skin depth.

In one embodiment, the resistance of the device, selected from tensile, torsion or bending resistance, or from a combination of said resistances, is predominantly imparted by the conductive layer comprising the smoothing layer.

In one embodiment, the resistance of the device, selected from tensile, torsion or bending resistance, or from a combination of said resistances, is predominantly imparted by the conductive layer comprising the smoothing layer over the range of operational temperatures of the device.

The use of a conductive layer thicker than that which would be required by the skin thickness also helps to smooth any roughness of the core resulting from the resolution of the 3D printer. Thus, the conductive layer also allows the roughness of the core to be reduced or even removed.

This smoothing layer also improves the structural, mechanical, thermal and chemical properties of the waveguide device.

In one embodiment, the device comprises an adhesion (or priming) layer between the core and the conductive layer. Preferably, the adhesion layer is on the inner surface of the core. The adhesion layer can be made of a conductive or non-conductive material. The adhesion layer allows the adhesion of the conductive layer on the core to be improved. Preferably, the thickness of the adhesion layer is less than the roughness Ra of the core and is less than the resolution of the method for additive manufacturing of the core.

In one embodiment, the device successively comprises a non-conductive core produced by additive manufacturing, an adhesion layer, a smoothing layer and a conductive layer. Thus, the adhesion layer and the smoothing layer allow the roughness of the surface of the waveguide channel to be reduced. The adhesion layer allows the adhesion of the core, which is conductive or non-conductive, with the smoothing layer and the conductive layer to be improved.

In one embodiment, the metal layer comprises a plurality of metal sub-layers. When the conductive layer comprises a plurality of successive layers of highly conductive metals, for example, Cu, Au, Ag, the skin depth δ is determined by the properties of the materials of all the layers in which the pellicular current is concentrated.

When the conductive layer comprises a plurality of successive sub-layers of metals, at least one of which is weakly conducting, for example, Ni, the skin depth δ of the weakly conducting sub-layer is negligible with respect to the computation of the thickness of the conductive layer, with most of the transmission of the RF signal being provided by the sub-layers made of highly conductive metals deposited above the sub-layer of weakly conducting materials.

In one embodiment, the conductive metal layer also covers the outer surface of the core. When the device is covered with a metal layer, the stiffness of the device is improved.

According to one embodiment, the core comprises at least one polymer and/or ceramic layer.

In one embodiment, the core is formed of a metal or an alloy. For example, the metal or the alloy is selected from among Cu, Au, Ag, Ni, Al, stainless steel, brass, or from a combination of these selections.

In one embodiment, the metal layer comprises a metal selected from among Cu, Au, Ag, Ni, Al, stainless steel or brass.

In one embodiment, the adhesion layer comprises a metal selected from among Cu, Au, Ag, Ni, Al, stainless steel, brass, a non-conductive material, for example, a polymer or a ceramic, or from a combination of these selections.

In one embodiment, the smoothing layer comprises a metal selected from among Cu, Au, Ag, Ni, Al, stainless steel, brass, a non-conductive material, for example, a polymer or a ceramic, or from a combination of these selections.

In one embodiment, the device successively comprises a core, an adhesion layer, a nickel smoothing layer, and said metal conductive layer.

According to one embodiment, the device successively comprises a non-conductive core, a first copper layer, a nickel layer, a second copper layer. The adhesion layer comprises the first copper layer. The smoothing layer comprises the layer of Ni. The metal layer comprises the second layer of Cu.

The invention also relates to a method for manufacturing a waveguide device for guiding a radiofrequency signal at a determined frequency f, the method comprising:

manufacturing a core made of conductive or, preferably, non-conductive material, comprising side walls with outer surfaces and inner surfaces, the inner surfaces defining a waveguide channel;

depositing a conductive layer onto the inner surface of the core, said conductive layer being formed of a metal characterized by a skin depth δ at the frequency f, the method being characterized in that the thickness of the metal conductive layer is at least as large as twenty times the skin depth δ.

According to one embodiment, depositing the conductive layer onto the core is performed by electrolytic or galvanoplastic deposition, chemical deposition, vacuum deposition, physical vapor deposition (PVD), printing deposition, sintering deposition.

In one embodiment of the method, the conductive layer comprises a plurality of successively deposited metal and/or non-metal layers.

In one embodiment, manufacturing the core comprises a step of additive manufacturing. "Additive manufacturing" is understood to be any method for manufacturing parts by adding material, according to computer data stored on a computer medium and defining a model of the part. In addition to stereolithography and selective laser melting, the term also denotes other methods for manufacturing by hardening or coagulating liquid or powder in particular, including, yet being by no means limited to, methods based on ink jets (binder jetting), DED (Direct Energy Deposition), EBFF (Electron Beam Freeform Fabrication), FDM (Fused Deposition Modeling), PFF (Plastic Freeforming), aerosols, BPM (Ballistic Particle Manufacturing), powder beds, SLS (Selective Laser Sintering), ALM (Additive Layer Manufacturing), polyjets, EBM (Electron Beam Melting), photopolymerization, etc. Manufacturing by stereolithography or by selective laser melting nevertheless is preferred since such manufacturing allows parts to be obtained with relatively clean surface finishes, with a low roughness level, which reduces the constraints on the smoothing layer.

The invention also relates to a manufacturing method comprising:

1) introducing data representing the shape of a core for a waveguide device, the core comprising side walls with outer surfaces and inner surfaces;

2) using this data to produce a core of a waveguide device by additive manufacturing;

3) depositing a conductive layer onto the core, the conductive layer being characterized by a skin depth δ at the frequency f, so as to cover the inner surfaces of the core in order to define a waveguide channel;

4) characterized in that said data representing the shape of a core are determined by taking into account the thickness of the conductive layer, so that the waveguide is optimized for transmitting RF signals at the frequency f, the thickness of the conductive layer being at least five times, preferably twenty times, as large as the skin depth S.

The dimensions of the waveguide channel are determined as a function of the frequency of the wave to be transmitted. The thickness of the conductive layers and the thickness of the walls of the core need to be known in order to compute the dimensions (width and height) of the waveguide channel. In the method according to the invention, the thickness of the core that is manufactured is computed by taking into account the abnormal thickness of the conductive layer that will be deposited onto the core in order to obtain a waveguide channel with the required dimensions.

The invention also relates to a computer data medium containing data intended to be read by an additive manufacturing device for manufacturing an object, the data representing the shape of a core for a waveguide device, the core comprising side walls with outer surfaces and inner surfaces, the inner surfaces defining a waveguide channel.

The computer data medium can be formed, for example, by a hard drive, a flash memory, a virtual drive, a USB stick, an optical disk, a network storage medium or can be of the cloud type, etc.

The embodiments of the waveguide device are applicable, mutatis mutandis, to the manufacturing methods and to the data medium according to the invention, and vice versa.

Within the scope of the invention, the terms "conductive layer", "conductive coating", "metal conductive layer" and "metal layer" are synonyms and are interchangeable.

BRIEF DESCRIPTION OF THE DRAWINGS

Embodiments of the invention are provided in the description, with reference to the accompanying drawings, where like features are denoted by the same reference numerals throughout the drawings, and in which:

FIGS. 5A-5O shows various possible sections of transmission channels in waveguide devices;

DETAILED DESCRIPTION

FIGS. 8A, 8B, 9A, 9B, 10A, and 10B show three embodiments of a waveguide device 1 according to the invention, in each instance with two sub-variations. The waveguide 1 comprises a core 3, for example, a core made of metal (aluminum, titanium or steel) polymer, epoxy, ceramic or organic material.

The core 3 is manufactured by additive manufacturing, preferably by stereolithography or by selective laser melting in order to reduce the roughness of the surface. The material of the core can be non-conductive or conductive. The thickness of the walls of the core is, for example, between 0.5 and 3 mm, preferably between 0.8 and 1.5 mm.

The shape of the core can be determined by a computer file stored in a computer data medium.

The core also can be formed by a plurality of parts formed by stereolithography or by selective laser melting and assembled together before plating, for example, by bonding or thermal fusion or mechanical assembly.

Figure 2:
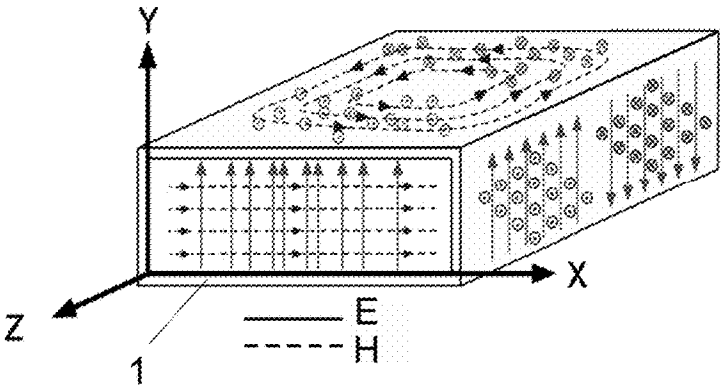
FIG. 2 shows the magnetic and electric field lines in the device of FIG. 1.
Figure 1:
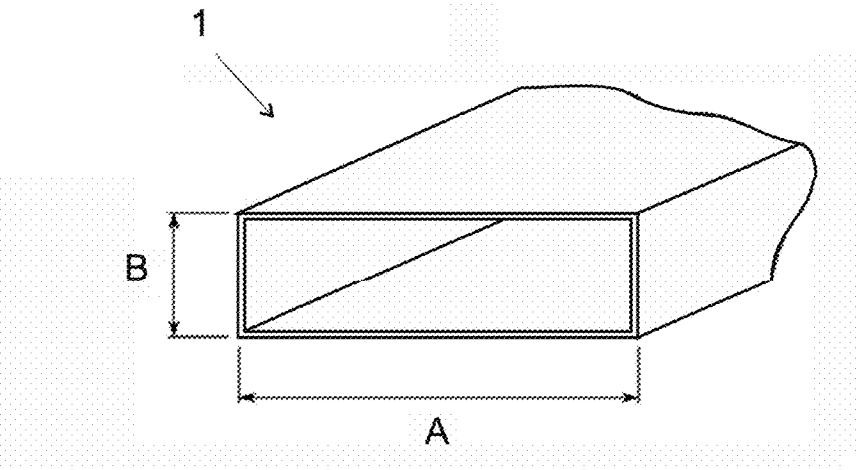
FIG. 1 shows a truncated perspective view of a conventional waveguide device with a rectangular section.
Figure 4:
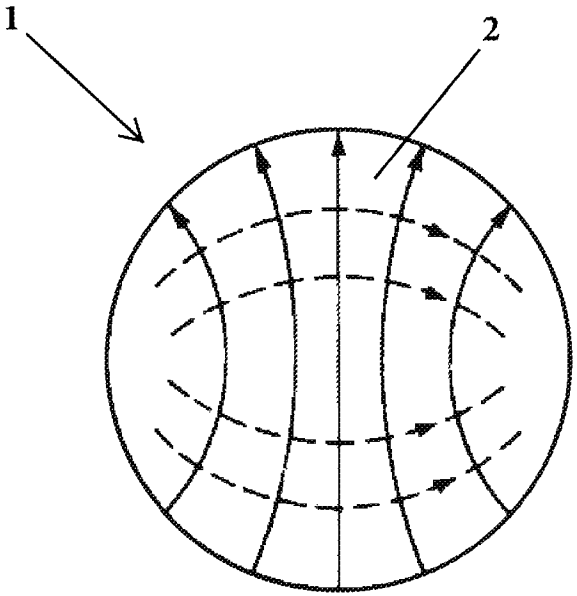
FIG. 4 shows the magnetic and electric field lines in the device of FIG. 3.
Figure 3:
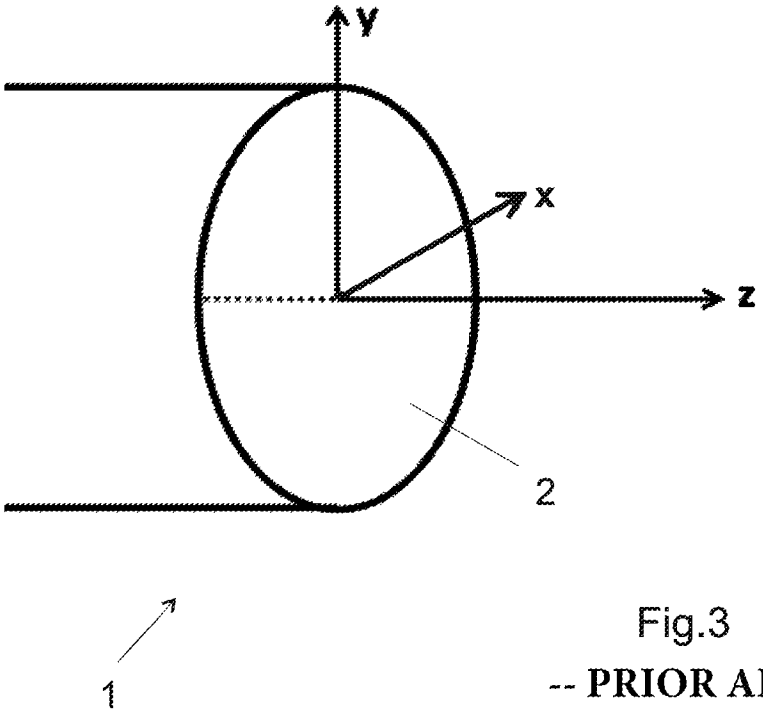
FIG. 3 shows a truncated perspective view of a conventional waveguide device with a circular section.
Figure 6B:
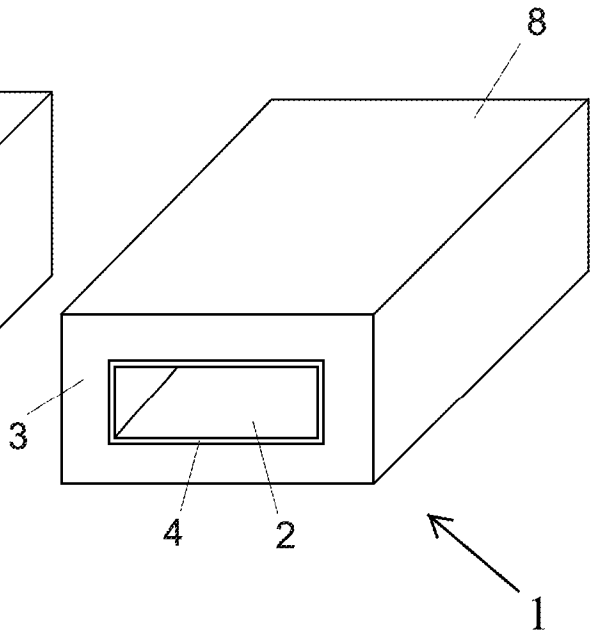
FIGS. 6A and 6B show a truncated perspective view of a waveguide device with a rectangular section produced by additive manufacturing and for which the inner and outer walls are both covered with a deposit of a conductive electrical material.
Figure 6A:
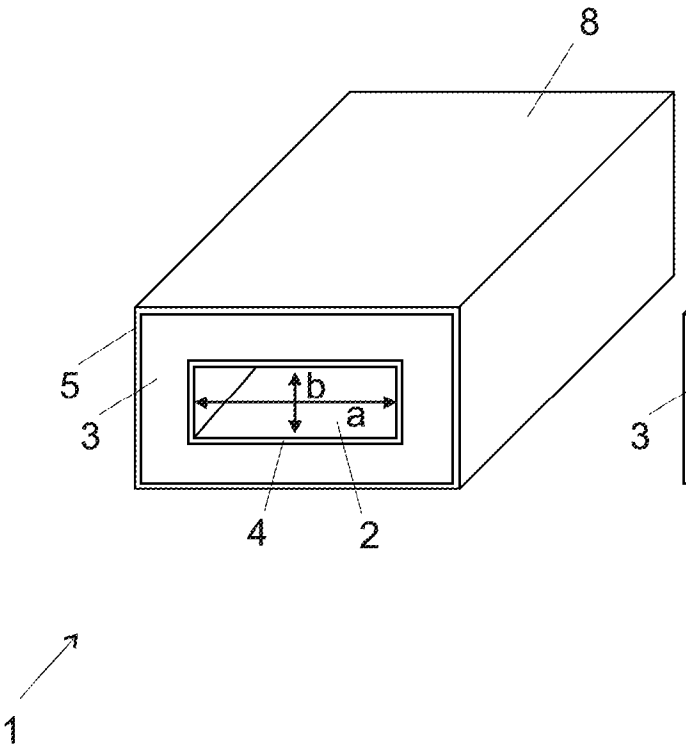
Figure 7:
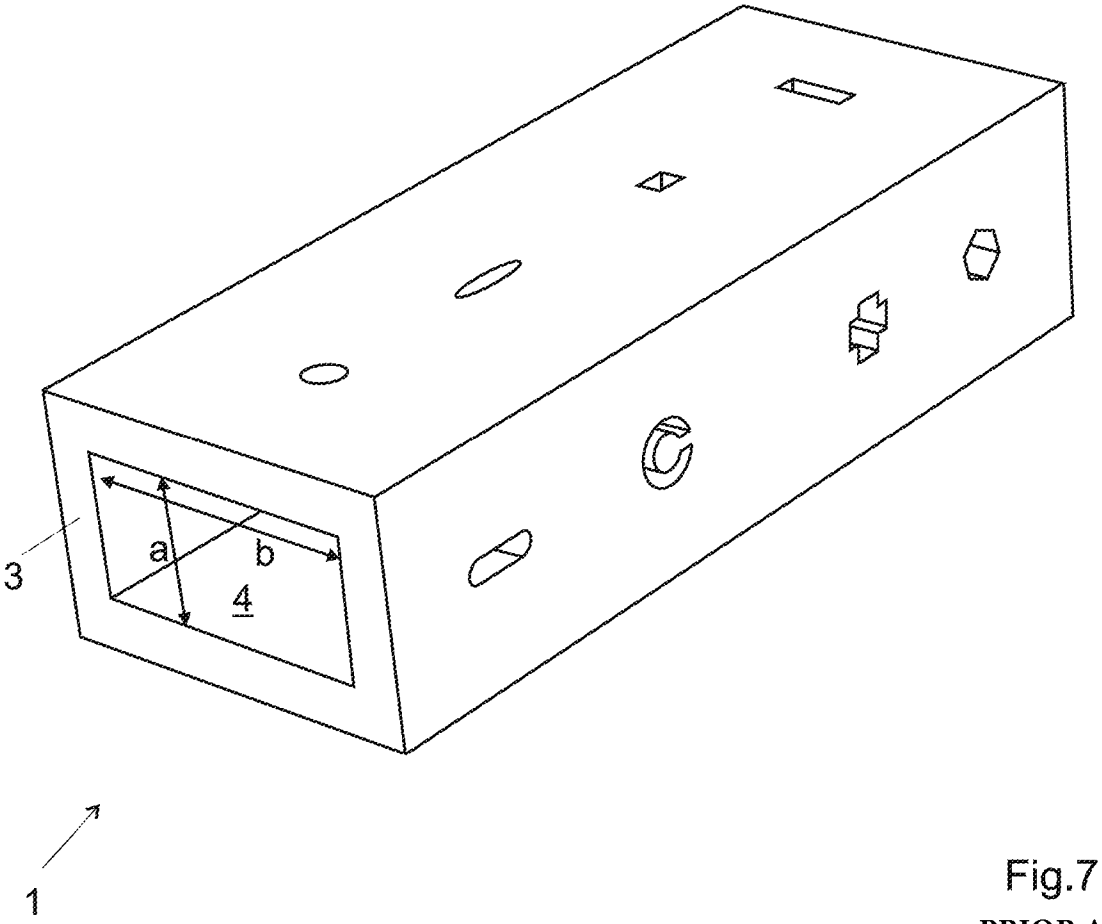
FIG. 7 shows a truncated perspective view of a waveguide device with a rectangular section produced by additive manufacturing and for which only the inner walls are covered with a deposit of a conductive electrical material.

This core 3 defines an internal channel 2, which is intended for guiding waves and the section of which is determined according to the frequency of the electromagnetic signal to be transmitted. The dimensions of this internal channel (i.e., dimensions a, b, shown for example in FIG. 6A) and its shape are determined as a function of the operational frequency of the device 1, i.e. the frequency of the electromagnetic signal for which the device is manufactured and for which a transmission mode that is stable and, optionally, has minimum attenuation is obtained.

The core 3 has an inner surface 7 and an outer surface 8, with the inner surface 7 covering the walls of the rectangular section opening 2.

Figure 8B:
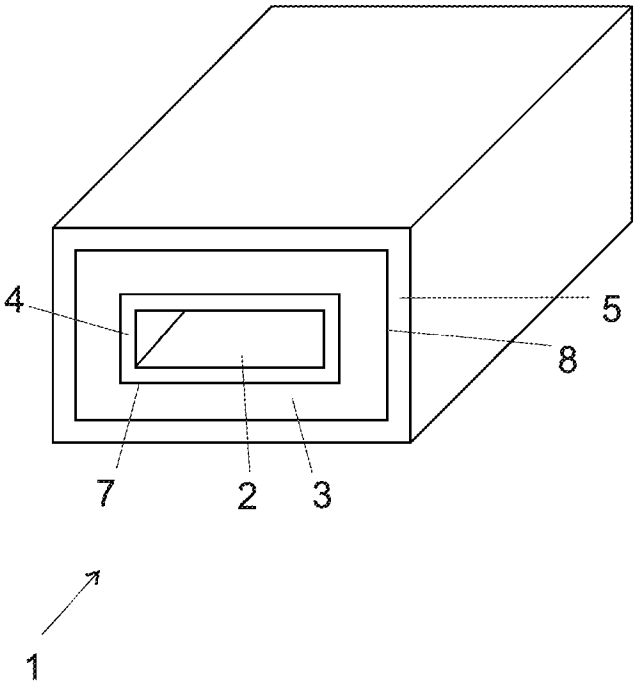
FIGS. 8A and 8B show a device according to a first embodiment, in which the core is covered with a single conductive layer on the inner face and, respectively, on the inner and outer face.
Figure 8A:
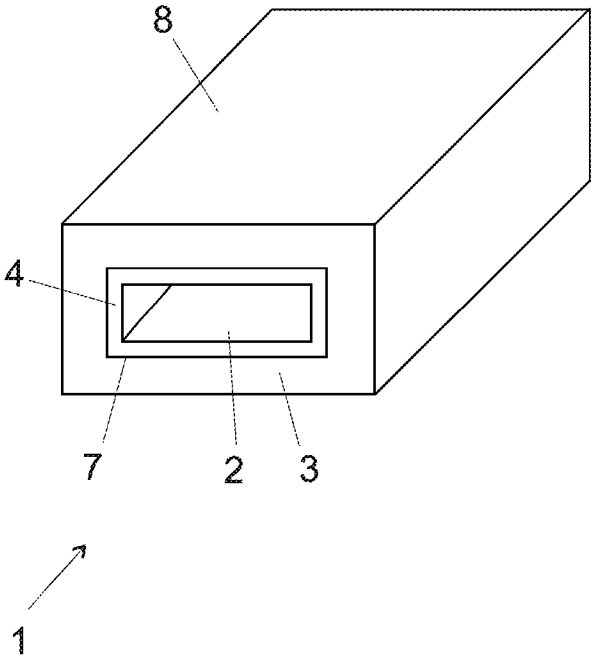

In a first embodiment shown in FIGS. 8A and 8B, the inner surface 7 of the polymer core 3 is covered with a conductive metal layer 4, for example, made of copper, silver, gold, nickel, etc., plated by chemical deposition without electric current. The thickness of this layer is, for example, between 1 and 20 micrometers, for example, between 4 and 10 micrometers.

This conductive coating 4 must be thick enough for the surface to be electrically conductive at the selected radiofrequency. This is typically obtained using a conductive layer that is thicker than the skin depth δ.

This thickness is substantially constant over all the inner surfaces in order to obtain a finished part with specific dimensional tolerances for the channel. According to the invention, the thickness of this layer 4 is at least twenty times greater than the skin depth in order to improve the structural, mechanical, thermal and chemical properties of the device.

In the embodiment of FIG. 8A, the outer surface 8 of the core is bare. In order to protect the surface, in the embodiment of FIG. 8B, this outer surface is also covered with a conductive layer 5, which also helps to improve the structural, mechanical, thermal and chemical properties of the device.

The conductive metal 4, 5 is deposited onto the inner faces 7 and, optionally, onto the outer faces 8 by immersing the core 3 in a series of successive baths, typically 1 to 15 baths. Each bath has a fluid with one or more reagents. Deposition does not require the application of a current on the core to be covered. A mix and an even deposit are obtained by stirring the fluid, for example, by pumping the fluid into the transmission channel and/or around the device or by vibrating the core 3 and/or the fluid tank, for example, with an ultrasound vibrating device in order to create ultrasonic waves.

Figure 9B:
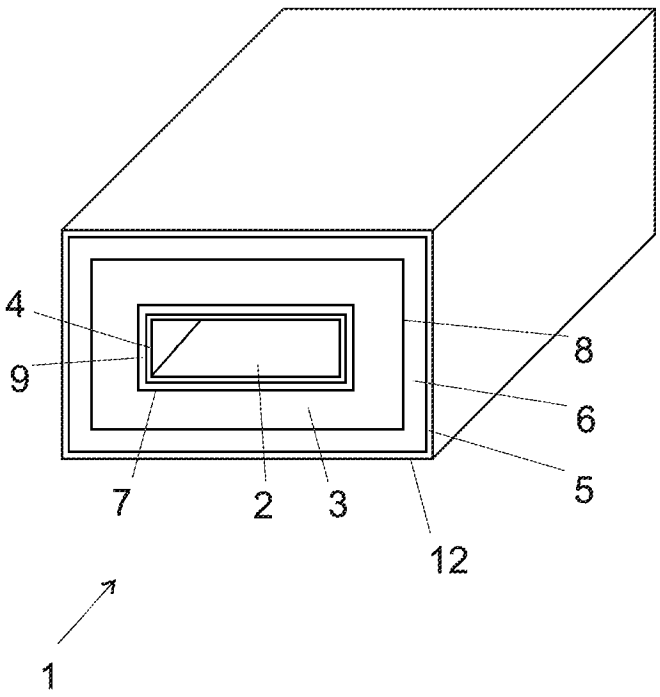
FIGS. 9A and 9B show a device according to a second embodiment, in which the core is covered with a smoothing layer, then with a conductive layer on the inner face and, respectively, on the inner and outer face.
Figure 9A:
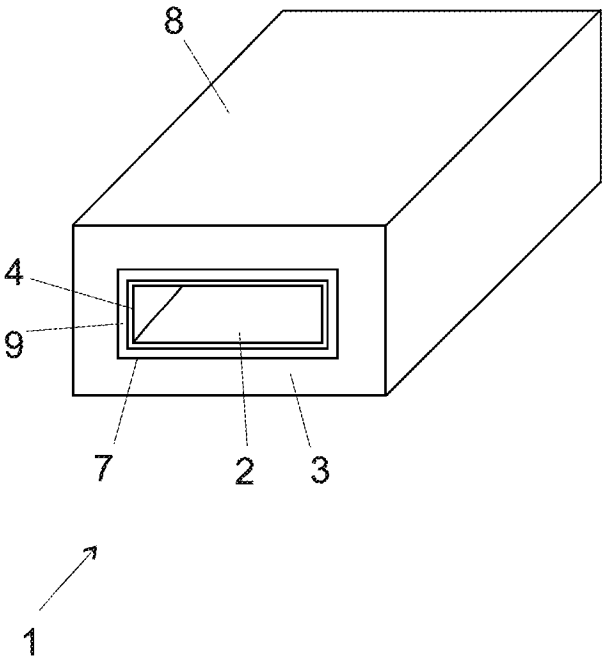

In the embodiment shown in FIG. 9A, the inner surface 7 of the polymer core 3 is covered with a smoothing layer 9, for example, a layer of Ni. The thickness of the smoothing layer 9 is at least equal to the roughness Ra of the inner surface 7, or at least equal to the resolution of the 3D printing method used to manufacture the core (with the resolution of the 3D printing method determining the roughness Ra of the surface). In one embodiment, the thickness of this layer is between 5 and 500 micrometers, preferably between 10 and 150 micrometers, preferably between 20 and 150 micrometers. This smoothing layer also determines the mechanical and thermal properties of the device 1. The layer of Ni 9 is subsequently covered with the conductive layer 4, which is made of copper, silver, gold, etc., for example.

The smoothing layer allows the surface of the core to be smoothed and therefore allows the transmission losses due to the roughness of the inner surface to be reduced.

In this embodiment, the core 3 is therefore covered with a metal layer formed by a smoothing layer 9 and by a conductive layer 4. The overall thickness of this metal layer is greater than or equal to five times, preferably twenty times, the skin depth δ. The value of the Young's modulus of the device 1 is predominantly provided by this metal layer. The thickness of the conductive layer 4 also can be only be greater than or equal to twenty times the skin depth δ. The most conductive layer preferably is deposited last, on the periphery.

Similarly, in FIG. 9B, the inner surface 7 of the non-conductive polymer core 3 is covered with a smoothing layer 9 made of Ni, which is deposited by chemical deposition. The layer of Ni 9 is subsequently covered by chemical deposition with a conductive layer 4 made of Cu, the thickness of which is at least equal to twenty skin thicknesses at the nominal transmission frequency of the waveguide. The outer surface 8 of the core 3 is also covered by chemical deposition with a smoothing layer 6 made of nickel, which also acts as a structural support. A conductive layer 5, for example, made of copper, can be deposited above this smoothing layer 6. An adhesion layer 12 can be deposited on the conductive layer 5.

Figure 10B:
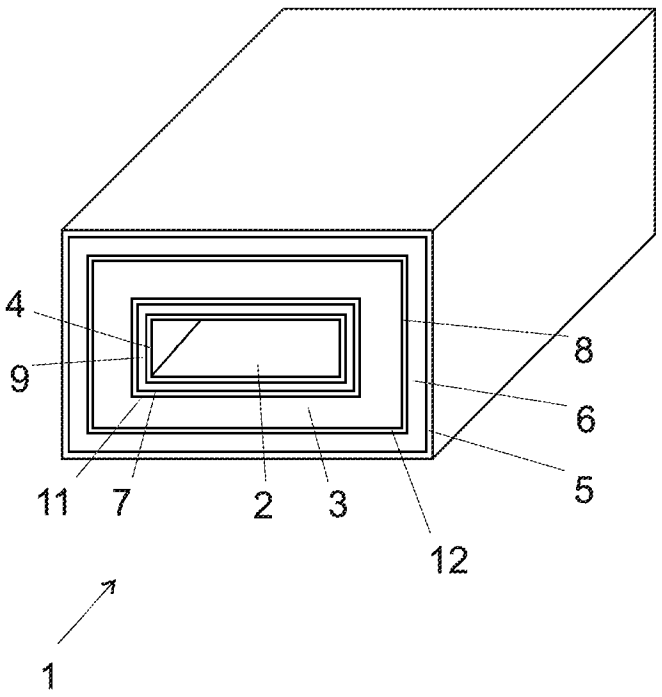
FIGS. 10A and 10B show a device according to a third embodiment, in which the core is covered with an adhesion layer, a smoothing layer, then with a conductive layer on the inner face and, respectively, on the inner and outer face.
Figure 10A:
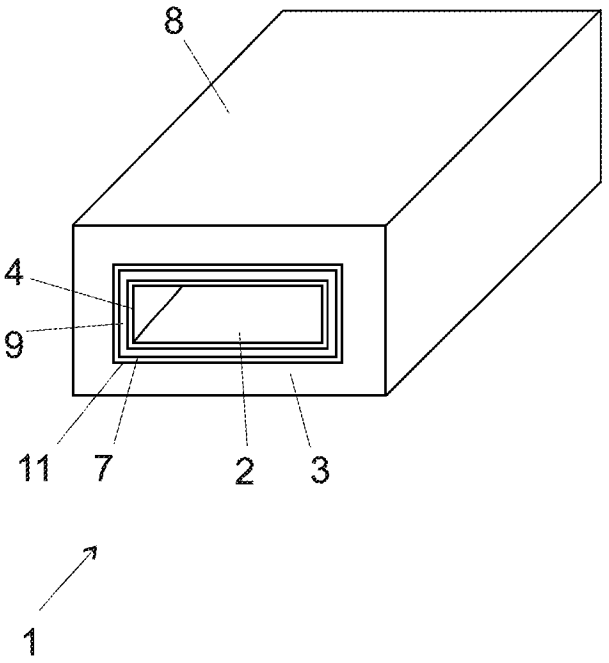

In the embodiment shown in FIGS. 10A and 10B, the waveguide 1 comprises an adhesion layer 11, for example, a layer of Cu, above the inner surface 7 of the core 3; this adhesion layer facilitates the subsequent deposition of the smoothing layer 9 if such a layer is provided, or of the conductive layer 4. The thickness of this layer advantageously is less than 30 micrometers.

Similarly, in FIG. 10B, the waveguide 1 comprises an adhesion layer 12, for example, a layer of Cu, above the outer surface 8 of the core 3; this adhesion layer facilitates the subsequent deposition of the smoothing layer 6.

Figures 11, 12:
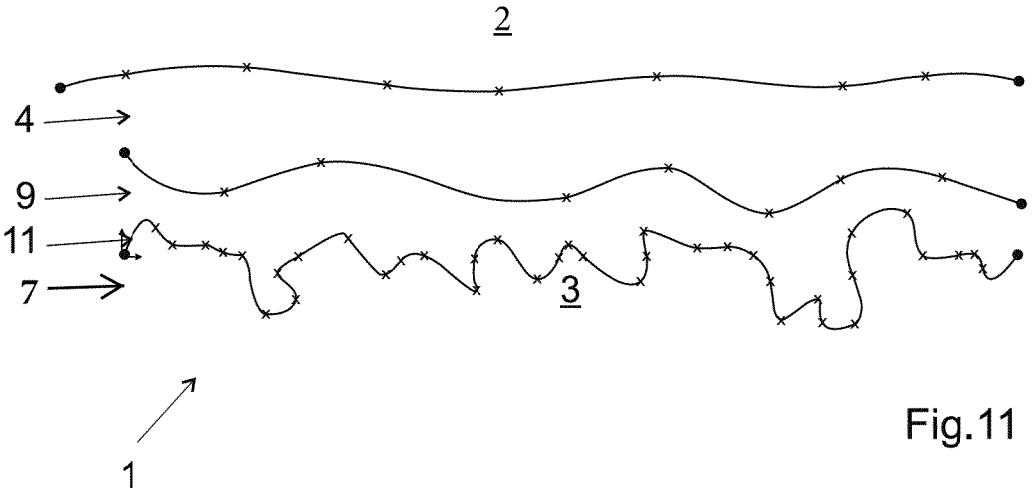
FIG. 11 shows a longitudinal section view of a portion of the rough surface of the core of the smoothing and conductive layer on this core.
FIG. 12 is a comparative table of the Young's moduli for a waveguide according to the prior art and a waveguide according to the present invention.

FIG. 11 is a diagram showing a longitudinal section of a portion of the inner surface 7 of the core 3 of a waveguide device 1 (e.g., the waveguide device 1 shown in FIG. 10A or 10B) comprising a waveguide channel 2. It can be seen that this inner surface is highly irregular or rough due to the additive manufacturing method.

Above the core 3, the waveguide 1 comprises an adhesion layer 11, for example, a layer of Cu that is between 1 and 10 micrometers thick.

Smoothing layer 9, for example, a layer of Ni, is deposited by chemical deposition and allows the irregularities of the layer of the surface of the core 3 (e.g., the core 3 of the waveguide device 1 shown in FIG. 10A or 10B) to be partially smoothed. The thickness of this smoothing layer is at least greater than the resolution of the additive printing system and thus of the roughness Ra of the surface. In one embodiment, the thickness of the smoothing layer 9 is between 5 and 500 micrometers, preferably between 20 and 150 micrometers.

A third conductive layer 4 made of copper or silver is deposited by chemical deposition onto the smoothing layer 9, the thickness thereof is preferably greater than or equal to twenty times the skin thickness at the nominal frequency f of the waveguide, so that the superficial currents are predominantly, even practically exclusively, concentrated in this layer. The relatively high thickness of this conductive layer 4 also allows the mechanical stiffness of the device to be enhanced. In one embodiment, the thickness of this layer is between 5 and 50 micrometers, preferably between 5 and 15 micrometers.

These deposits (i.e., the conductive layer 4, the smoothing layer 9, and the adhesion layer 11) can be applied, mutatis mutandis, to the outer surface 8.

The table in FIG. 12 compares the Young's modulus (in $N/mm^2$) of a waveguide 1 entirely made of aluminum with the Young's modulus of a waveguide device 1 according to the invention. The waveguide according to the prior art that is used for this comparison is formed by a 500 micrometer thick sheet of aluminum material with a Young's modulus of 72,500 $N/mm^2$. The waveguide 1 according to the invention that is used in this example comprises a 1 mm thick polymer core 3 with a Young's modulus of 10500 $N/mm^2$, a 5 micrometer thick adhesion layer 11 made of Cu, a 90 micrometer thick smoothing layer 9 made of Ni and a 5 micrometer thick conductive layer 4 made of Cu. The overall thickness of the coating thus is 100 micrometers for a Young's modulus of 214,000 N/mm2. The influence of the Cu adhesion layer 11 and the Cu conductive layer 4 on the Young's modulus is negligible. It is to be noted that the bending resistance (bending stiffness) of the waveguide according to the invention is greater than that of the waveguide made entirely of aluminum according to the prior art, yet with a lower weight.

REFERENCE NUMERALS USED IN THE FIGURES

| | |
|---|---|
| 1 | Waveguide device |
| a | Waveguide height |
| b | Waveguide width |
| 2 | Waveguide channel |
| 3 | Core |
| 4 | Inner conductive coating |
| 5 | Outer conductive coating |
| 6 | Smoothing or structural layer |
| 7 | Inner surface of the core |
| 8 | Outer surface of the core |
| 9 | Smoothing layer |
| 11 | Inner adhesion layer |
| 12 | Outer adhesion layer |

What is claimed is:

1. A waveguide device for guiding a radiofrequency signal at a determined frequency f, the device comprising:

a core manufactured by additive manufacturing and comprising side walls with outer surfaces and inner surfaces, the inner surfaces defining a waveguide channel;

a smoothing layer covering the inner surface of the core produced so as to at least partially smooth irregularities in a layer of the inner surface of the core;

a metal conductive layer covering the smoothing layer, said metal conductive layer being formed of a metal having a skin depth δ at the frequency f, wherein the thickness of the metal conductive layer is at least five times as large as said skin depth δ and wherein the core is formed of a metal or an alloy.

2. The waveguide device of claim 1, wherein the thickness of said smoothing layer is between 5 and 500 microns.

3. The waveguide device of claim 1, wherein the thickness of said smoothing layer is greater than or equal to a roughness (Ra) of the core.

4. The waveguide device of claim 1, wherein the thickness of said smoothing layer is greater than or equal to the resolution of an additive manufacturing method for manufacturing the core.

5. The waveguide device of claim 1, wherein the smoothing layer is formed of nickel.

6. The waveguide device of claim 1, wherein the waveguide device comprises a metal layer covering the outer surface of the core.

7. The waveguide device of claim 1, wherein the metal or alloy core is formed of aluminum, titanium or steel.

8. The waveguide device of claim 1, wherein a resistance of the waveguide device, selected from tensile resistance, torsion resistance or or bending resistance, or from a combination of said resistances, being predominantly imparted by the metal conductive layer and by the smoothing layer.

9. The waveguide device of claim 1, wherein a resistance of the waveguide device, selected from tensile resistance, torsion resistance or bending resistance, or from a combination of said resistances, being predominantly imparted by the metal conductive layer.

10. The waveguide device of claim 1, wherein the core is produced by stereolithography or by selective laser melting.

11. The waveguide device of claim 1, wherein the metal layer comprises a metal selected from Cu, Au, Ag, Ni, Al, stainless steel or brass, or from a combination of these metals.

12. The waveguide device of claim 1, wherein the thickness of said metal conductive layer is at least twenty times as large as said skin depth δ.

13. The waveguide device of claim 1, wherein the waveguide device further comprises an adhesion layer between said core and said smoothing layer.

14. A computer data medium comprising data intended for additive manufacturing of the core of the waveguide device as claimed in claim 1, said data representing the shape of the core being determined so that the waveguide device is optimized to transmit RF signals at the frequency f, while taking into account the thickness of the smoothing layer superposed on said core, said thickness being greater than or equal to the resolution of the additive manufacturing method, and of the thickness of the conductive layer superposed on the smoothing layer.

15. A waveguide device for guiding a radiofrequency signal at a determined frequency f, the device comprising:

a core manufactured by additive manufacturing and comprising side walls with outer surfaces and inner surfaces, the inner surfaces defining a waveguide channel;

a smoothing layer covering the inner surface of the core, produced so as to at least partially smooth irregularities in a layer of the inner surface of the core;

a metal conductive layer covering the smoothing layer, said metal conductive layer being formed of a metal having a skin depth δ at the frequency f, wherein the thickness of the metal conductive layer is at least five times as large as said skin depth δ, wherein the thickness of said metal conductive layer being at least twenty times as large as said skin depth δ.

16. A method for manufacturing a waveguide device for guiding a radiofrequency signal at a determined frequency f, the method comprising:

manufacturing a core comprising side walls with outer surfaces and inner surfaces, the inner surfaces defining a waveguide channel;

successively depositing a smoothing layer and a conductive layer onto the inner surface of the core, the thickness of the smoothing layer being greater than or equal to a roughness (Ra) of the core, so as to at least partially smooth irregularities in a layer of the inner surface of the core, said conductive layer being formed of a metal characterized by a skin depth δ at the frequency f, wherein the thickness of said conductive layer being at least five times as large as said skin depth δ, and wherein the core is formed of a metal or an alloy.

17. The method as claimed in claim 16, wherein the manufacture of the core comprises a step of additive manufacturing by stereolithography or by selective laser melting.

18. The method as claimed in claim 17, wherein the method comprises depositing an adhesion layer between said core and said smoothing layer.

* * * * *